US006047915A

United States Patent [19]

Jaschke

[11] Patent Number: 6,047,915

[45] Date of Patent: Apr. 11, 2000

[54] EJECTOR FOR PUSHING YARN PACKAGES FROM A WINDING SPINDLE ONTO A MANDREL

[75] Inventor: Klemens Jaschke, Hückeswagen, Germany

[73] Assignee: Barmag AG, Remscheid, Germany

[21] Appl. No.: 09/125,536

[22] PCT Filed: Nov. 25, 1997

[86] PCT No.: PCT/EP97/06561

§ 371 Date: Aug. 20, 1998

§ 102(e) Date: Aug. 20, 1998

[87] PCT Pub. No.: WO98/28218

PCT Pub. Date: Jul. 2, 1998

[30] Foreign Application Priority Data

Dec. 20, 1996 [DE] Germany ..... 196 53 544
Aug. 20, 1997 [DE] Germany ..... 197 36 190

[51] Int. Cl.[7] ..... B65H 54/22

[52] U.S. Cl. ..... 242/473.9; 242/533.7

[58] Field of Search ..... 242/473.9, 533.7

[56] References Cited

U.S. PATENT DOCUMENTS

| | | | |
|---|---|---|---|
| 3,722,807 | 3/1973 | Swinehart . | |
| 3,881,603 | 5/1975 | Stotler et al. . | |
| 3,974,973 | 8/1976 | Lenk et al. . | |
| 4,007,884 | 2/1977 | Schippers et al. | 242/473.9 |
| 4,099,682 | 7/1978 | Benuska | 242/533.7 X |
| 4,557,424 | 12/1985 | Schneeberger | 242/473.9 |
| 5,029,762 | 7/1991 | Behrens et al. . | |
| 5,715,735 | 2/1998 | Alden et al. | 82/124 |
| 5,896,976 | 4/1999 | Jaschke | 57/352 |
| 5,924,272 | 7/1999 | Jaschke et al. | 57/279 |
| 5,941,474 | 8/1999 | Cushing | 242/533.7 X |

FOREIGN PATENT DOCUMENTS

| | | | |
|---|---|---|---|
| 0 374 536 | of 0000 | European Pat. Off. . | |
| 1597803 | 3/1968 | France | 242/533.7 |
| 2 121 286 | 8/1972 | France . | |
| 24 38 363 | 9/1975 | Germany . | |

*Primary Examiner*—Donald P. Walsh
*Assistant Examiner*—Minh-Chau Pham
*Attorney, Agent, or Firm*—Alston & Bird LLP

[57] ABSTRACT

For pushing packages (7) from a winding mandrel (4) of a takeup apparatus (1), an ejector is provided, which has a piston arranged for reciprocating movement in a cylinder (8) by supplying a pressure medium. The piston is a magnetic piston, whose polarity is opposite to that of at least one magnet connected to a push unit (9). The push unit (9) is displaceable substantially along the cylinder (8) with the movement of the piston.

17 Claims, 10 Drawing Sheets

EJECTOR FOR PUSHING YARN PACKAGES FROM A WINDING SPINDLE ONTO A MANDREL

BACKGROUND OF THE INVENTION

The subject matter of the invention relates to an ejector or push device for pushing tubes or packages onto a mandrel.

Fibers, in particular synthetic fibers, are wound by means of so-called takeup apparatus. To this end, a takeup apparatus comprises at least one winding mandrel that holds at least one tube, on which the fiber is wound. After completing the winding operation, the package is transferred from the mandrel to a package transportation device. Such package transportation devices are also described doffers. The package transportation device is adapted for traveling along the front of the takeup apparatus. At a height, in which the winding mandrel with a fully wound package thereon is located, the package transportation device is provided with a receiving mandrel which is aligned in this position with the winding mandrel. The full package on the winding mandrel is pushed by means of a push device from the winding mandrel to the receiving mandrel of the package transportation device. It is possible to wind on one mandrel of a takeup apparatus a plurality of packages at the same time. During the transfer operation, all packages on the winding mandrel are pushed by means of the push device onto the receiving mandrel of the package transportation device. For pushing the full packages from a winding mandrel of a takeup apparatus, the push device is provided with a push unit which is displaceable substantially parallel to the winding mandrel. On the front surface of the takeup apparatus facing the machine, the push device engages from behind the winding tube, on which a fiber is wound and a package is formed, and pushes same from the winding mandrel onto the receiving mandrel. In like manner, it is also possible to push empty tubes onto the winding mandrel. Such a push device for takeup apparatus is known, for example, from EP 0 374 536 B1 and corresponding U.S. Pat. No. 5,029,762; and DE 24 38 363 C2 and corresponding U.S. Pat. No. 3,974,973.

To actuate the push unit, the push device comprises a cylinder-piston unit. The piston of the cylinder-piston unit is coupled with the push unit. The movement of the piston is transferred to the push unit. In the known push unit, the piston is connected via a piston rod to the push unit. A corresponding application of a pressure medium to the cylinder-piston unit facilitates movement of the push unit. The displacement of the push unit corresponds at least to the length of the winding mandrel, so as to make sure that the package on a winding mandrel is safely and reliably pushed onto the receiving mandrel of a package transportation device. Therefore, in the known push devices, the length of the cylinder, in which the piston is displaced, corresponds substantially to the length of the winding mandrel. In view of the fact that the push unit is displaced substantially parallel to the winding mandrel, the push unit contributes quite significantly to the length of the takeup apparatus. This necessitates a corresponding space requirement for the takeup apparatus.

Based on the foregoing, it is the object of the present invention to further develop the known push device such that same is of a compact, space-saving construction. A further object of the invention is to describe a takeup apparatus with a push device, with the takeup apparatus being of a compact construction.

SUMMARY OF THE INVENTION

The above and other objects and advantages of the present invention are provided by a winding apparatus which includes an ejector or push device which comprises a tubular casing, and a magnetic piston mounted for sliding movement within the tubular casing. A push unit is mounted for sliding movement on the outside of the tubular casing and the push unit is magnetically coupled to the magnetic piston so that the push unit follows the sliding movement of the magnetic piston. Also, the push unit includes a pusher which is configured to engage a yarn package mounted on a winding spindle. A control means is provided for selectively moving the magnetic piston and thus the push unit in either direction along the tubular casing.

In the configuration of the push unit according to the invention, a piston rod of the prior art that connects the piston with the push unit, is absent. As a result, a compact construction of the push device is realized, since the length of the push device corresponds substantially to a predetermined path of displacement.

A further advantage of the push device in accordance with the invention is to be seen in that the magnetic coupling of the magnetic piston with the push unit permits minimization of potential sealing problems of the cylinder-piston unit.

According to an advantageous embodiment of the push unit, it is suggested that the push unit be displaceable on the cylinder. This further development has the advantage that an additional guide mechanism of the push unit may be omitted.

A guide mechanism along which the push unit is guided may be useful, when the cylinder in which the piston is guided, is a standard component having a relatively high surface roughness. The surface roughness may lead to high friction losses, which would make it necessary to operate the push device under higher pressures. It may be useful to provide a guide mechanism even when the outer circumference of the cylinder is relatively large. It is not absolutely necessary that the cylinder have a circular outer contour. Polygonal contours are likewise possible. However, it will be useful to construct the cylinder with a circular cross section. In this instance, the cylinder may be formed by a tube.

Preferably, the push unit is constructed for sliding movement. A sliding movement has the advantage that the displacement resistance and a wear of the push unit are minimized.

In accordance with another advantageous further development of the push unit, it is proposed to displace the push unit against at least one stop. Preferably, the stop is arranged respectively in at least one end region of the cylinder or guide mechanism. This allows to ensure that the push unit is unable to leave the cylinder, on which it is guided, or the guide mechanism. A further advantage of this configuration may be seen in that positionable stops also facilitate adaptation of a push device to different paths of displacement of the push unit.

The magnetic coupling between the push unit and the piston may be effected by means of electromagnets or by means of permanent magnets. Preferred is a configuration of the push unit, in which the magnetic coupling of the magnetic piston with the push unit is realized by permanent magnets. This configuration has the advantage that electric lines and magnetic coils can be omitted. It is therefore suggested that the magnetic piston have at least one disk-shaped permanent magnet. The push unit has preferably at least one annular permanent magnet. Preferably, the permanent magnets are constructed with axially aligned magnetization. This has the advantage that with the use of a circular piston a protection against torsion may be omitted. A radially aligned magnetization of the permanent magnets is advantageously used for pistons of a rotationally asymmetric construction.

When several magnets are used in the configuration of the magnetic piston, it is proposed for the alignment of the magnetic flux to arrange one pole plate each between two adjacent magnets. The push unit may likewise have a corresponding configuration. This makes it possible to increase the transmission of magnetic force. It is therefore preferred to use such a configuration of the push device for purposes of displacing several packages of one winding mandrel.

In yet another advantageous configuration of the push device it is proposed to provide the push unit with a support, which connects to at least one magnet of the push unit, and a bifurcate pusher, which is connected to the support. Preferably, at least the pusher of the push unit is constructed for rotation about an axis. This axis may be formed by the cylinder itself or by an axis extending parallel to the cylinder. Such a configuration of a push device is suitable in particular for a takeup apparatus with a plurality of winding mandrels, such as is described, for example, in EP 0 374 536. In this instance, the bifurcate pusher is rotatable in such a manner that same is movable to a gripping position, in which a winding mandrel is engaged with the bifurcate pusher, and a rotation of the winding turret causes the pusher to be carried along by the winding mandrel, until the winding mandrel reaches a position, in which packages are doffed and empty tubes are pushed onto the winding mandrel. During a continued rotation of the winding turret, the pusher is then rotated to a deflected position, so that the winding mandrel disengages from the pusher only by rotation of the winding turret.

Preferably, the push device comprises a resetting unit, which permits movement of the pusher from a pushing position to a gripping position. Preferably, the resetting unit is formed by at least one spring acting at least upon the pusher. Such a configuration of the resetting unit is constructionally simple and reliable. It is suggested that the spring be a tension spring connected with the pusher and the support. When the pusher is disengaged from a mandrel, in particular a winding mandrel, or from a winding tube after completing the pushing operation, the tension spring will pull back the pusher to its gripping position.

In a further advantageous configuration of the push device, it is suggested that the resetting unit have a stationarily arranged compression spring. This configuration of the push device will be especially useful, when it is used in combination with a takeup apparatus, in which the bifurcate pusher is disengaged from the winding mandrel by rotating the winding turret. Preferably, the resetting unit is provided with at least one stop element which is displaceable against the force of a spring, and has at least one surface extending at such an angle with the axial direction of the cylinder, so as to be able to bring at least the pusher from its deflected position to its gripping position.

A further inventive concept proposes a takeup apparatus having at least one rotatable winding mandrel and a push device in accordance with the present invention, thereby realizing a compact construction of the takeup apparatus.

Preferably, the takeup apparatus is designed and constructed such that it comprises a plurality of rotatable winding mandrels in spaced relationship. Such takeup apparatus are suitable in particular for continuously winding an advancing yarn. The winding mandrels are arranged for movement along a guide path, and are alternately moved from a winding range to a doffing range. In the winding range, at least one yarn is wound to a package. In the doffing range, the package is doffed, i.e., the full package is pushed off the winding mandrel, and a number of empty tubes corresponding to the winding positions are pushed onto the winding mandrel. To be able to proceed with removal of the full package, a cutout of the pusher extends into the guide path of the winding mandrels, when the pusher is in its gripping position, so that the winding mandrel which is moved to the doffing range, automatically engages the pusher. This configuration of the takeup apparatus has the advantage that the package doff can occur automatically. The control of the push device may be realized via a central machine control unit.

In an especially advantageous further development of the takeup apparatus, the winding mandrels are arranged on a rotatable turret plate. In this arrangement, the pusher can be rotated from its gripping position to its deflected position by rotating the driven turret plate.

To ensure a reliable cooperation between one of the winding mandrels and the push device, it is of advantage to use that constructional variant, in which the push unit is nonactuatable in a starting position, with the pusher being in the gripping position or in the deflected position.

Preferably, the takeup apparatus is designed and constructed such that at least one winding mandrel is provided with a push sleeve for engagement with the pusher, which push sleeve can be moved for contacting at least one winding tube of a package. The push sleeve pushes the winding tube from the winding mandrel.

Suitably, the push sleeve is arranged on the winding mandrel for nonrotation at least in the gripping position of the pusher.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
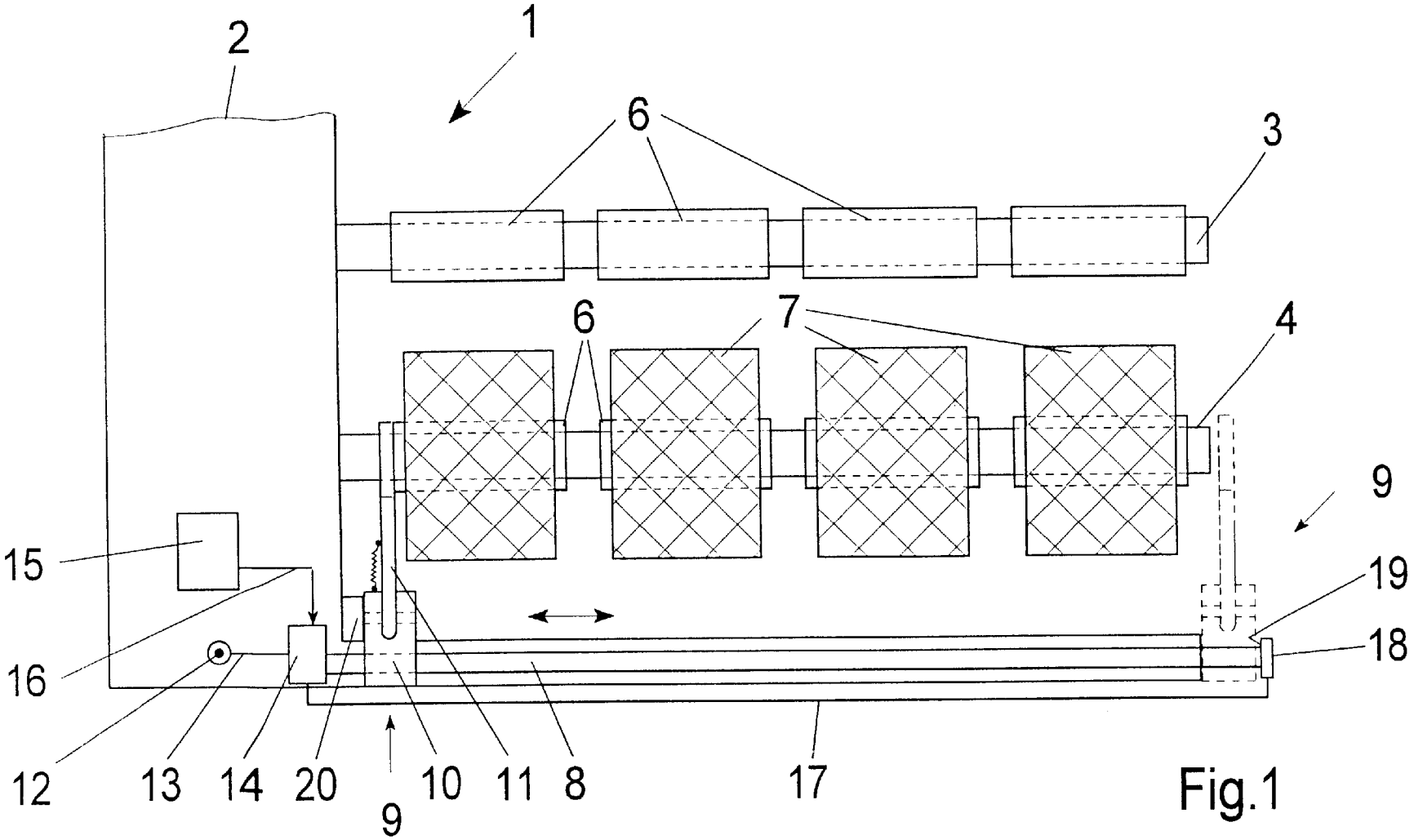
FIG. 1 is a schematic view of a takeup apparatus and a push device.

FIG. 1 illustrates a takeup apparatus 1. The takeup apparatus 1 comprises a machine frame 2. Furthermore, the takeup apparatus 1 includes two spaced-apart winding mandrels 3, 4. The winding mandrels are cantilevered for movement on machine frame 2. In this arrangement, the movement of the winding mandrel may be realized, for example by a turret plate, a slide, or a chain drive. The winding mandrels can be driven via rotational drive mechanisms not shown.

The winding mandrels are alternately moved to a winding range and to a doffing range. In the winding range, a yarn is wound to a package, whereas in the doffing range the fully wound package is exchanged for a new empty tube. In FIG. 1, the winding mandrel 4 is shown in its doffing position. The winding range is not shown.

In the schematic illustration, the winding mandrel 3 holds a total of four tubes 6, on which one yarn each can be wound per winding position. Indicated at 7 is an already fully wound package. The packages 7 are arranged on winding mandrel 4.

For pushing packages 7 from mandrel 4 a push device is provided. The push device includes a substantially tubular casing or cylinder 8 which extends substantially parallel to winding mandrel 4.

The cylinder 8 can be supplied with a pressure medium. To this end, a pressure medium connection 12 is provided from which the pressure medium can be supplied into cylinder 8 via a line 13, a control valve 14, and via a line 17. The control valve 14 is arranged at one end of cylinder 8. The line 17 is connected, via a connection 18, with the opposite end of cylinder 8. The cylinder 8 can be supplied in either end with the pressure medium, which may be, for example, air or oil.

Arranged inside cylinder 8 is a magnetic piston having a polarity opposite to at least one of the magnets connected to a push unit 9. The push unit 9 is displaceable substantially along cylinder 8.

In FIG. 1, this push unit 9 is shown in its gripping position. A pusher 11 lies against the tube 6 of package 7 adjacent machine frame 2. When cylinder 8 receives via control valve 14 a pressure medium, the push unit 9 is caused to displace by its magnetic coupling with the magnetic piston in the direction toward the free end of winding mandrel 4. During this displacement action, the packages 7 are pushed from winding mandrel 4 onto to a receiving mandrel of a package transportation device not shown. FIG. 1 shows in phantom lines the end position of push unit 9, in which packages 7 have been pushed off winding mandrel 4. In this position, push unit 9 reaches a stop 19. For a return movement of push unit 9, control valve 14 is triggered via a control circuit 15 and control line 16. The cylinder 8 is substantially depressurized, and a pressure medium is supplied via line 17 and line connection 18. The push unit 9 is moved to its gripping position, which is defined by a stop 20 arranged adjacent machine frame 2.

Figure 2:
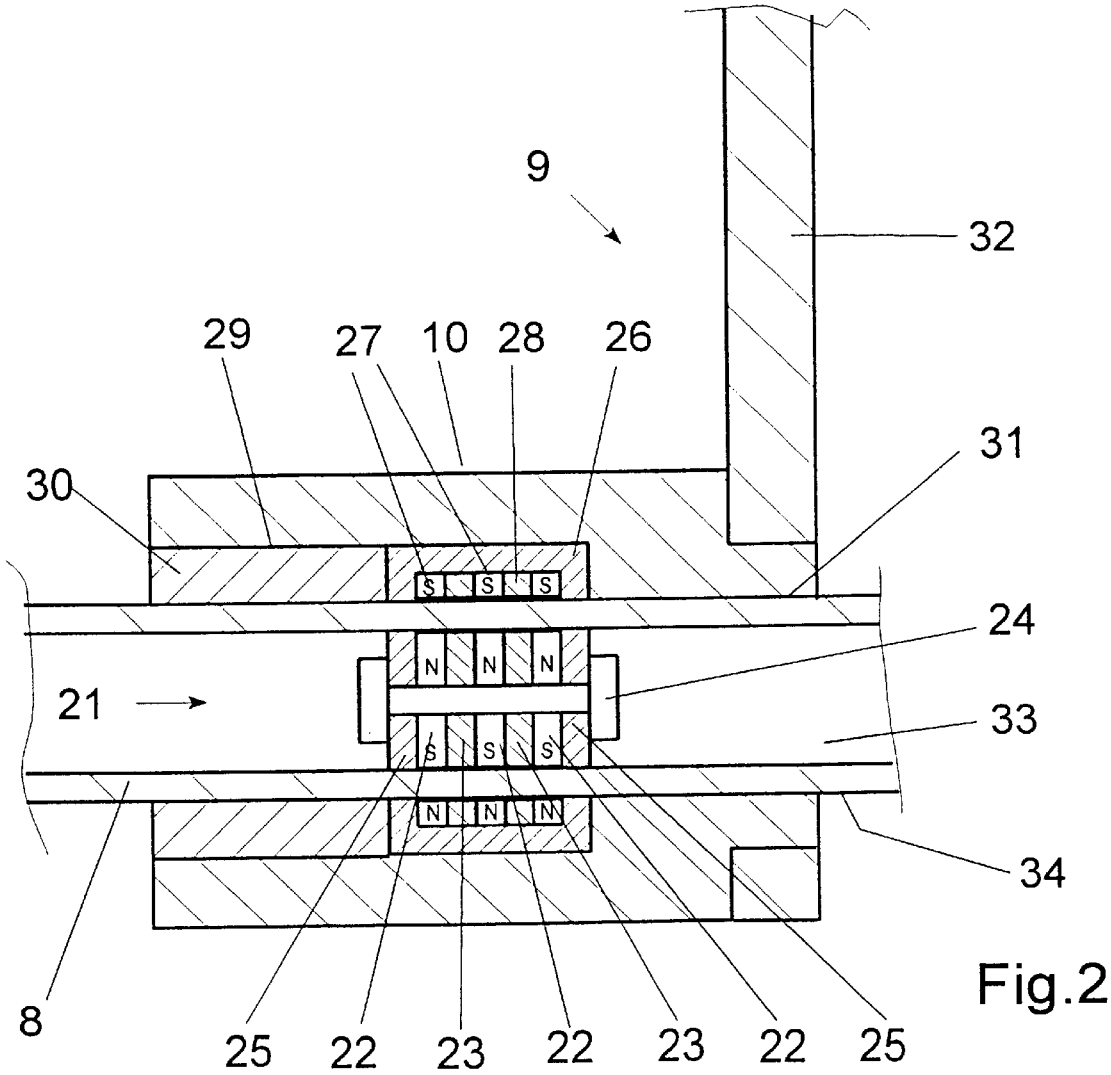
FIG. 2 is a schematic sectional view of a push unit and a magnetic piston.

FIG. 2 is a sectional view of push unit 9, cylinder 8, as well as of a magnetic piston 21. The cylinder 8 has a channel 33 with a substantially circular cross section. In channel 33, magnetic piston 21 is arranged for displacement. In the illustrated embodiment, the magnet piston 21 comprises three disk-shaped magnets 22, which are permanent magnets. Between two magnets 22 each a pole plate 23 is arranged. Each front end of magnetic piston 21 mounts a plate 25. In the axial direction of magnetic piston 21, a connecting element 24 extends, which combines magnets 22 and poles plates 23 by means of plates 25 to a package. The peripheral edge of each plate 25 is also used to seal piston 21 against the surface of channel 33, so that when pressure is applied to channel 33, the pressure medium exerts from one end of cylinder 8 a pressure on magnetic piston 21, so that same is displaced in channel 33.

Figure 4:
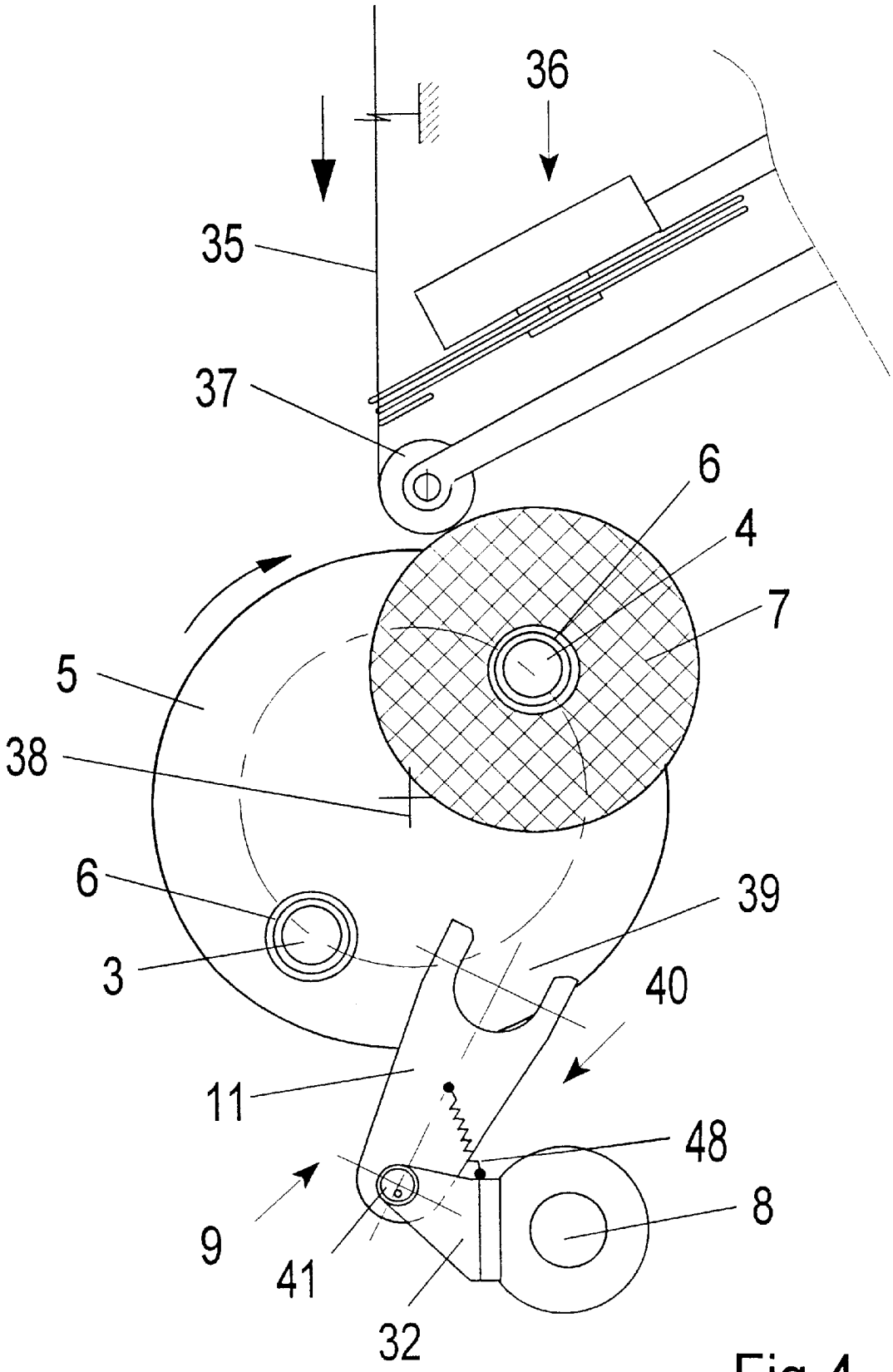
FIG. 4 illustrates a takeup apparatus with a push device in a gripping position.
Figure 7:
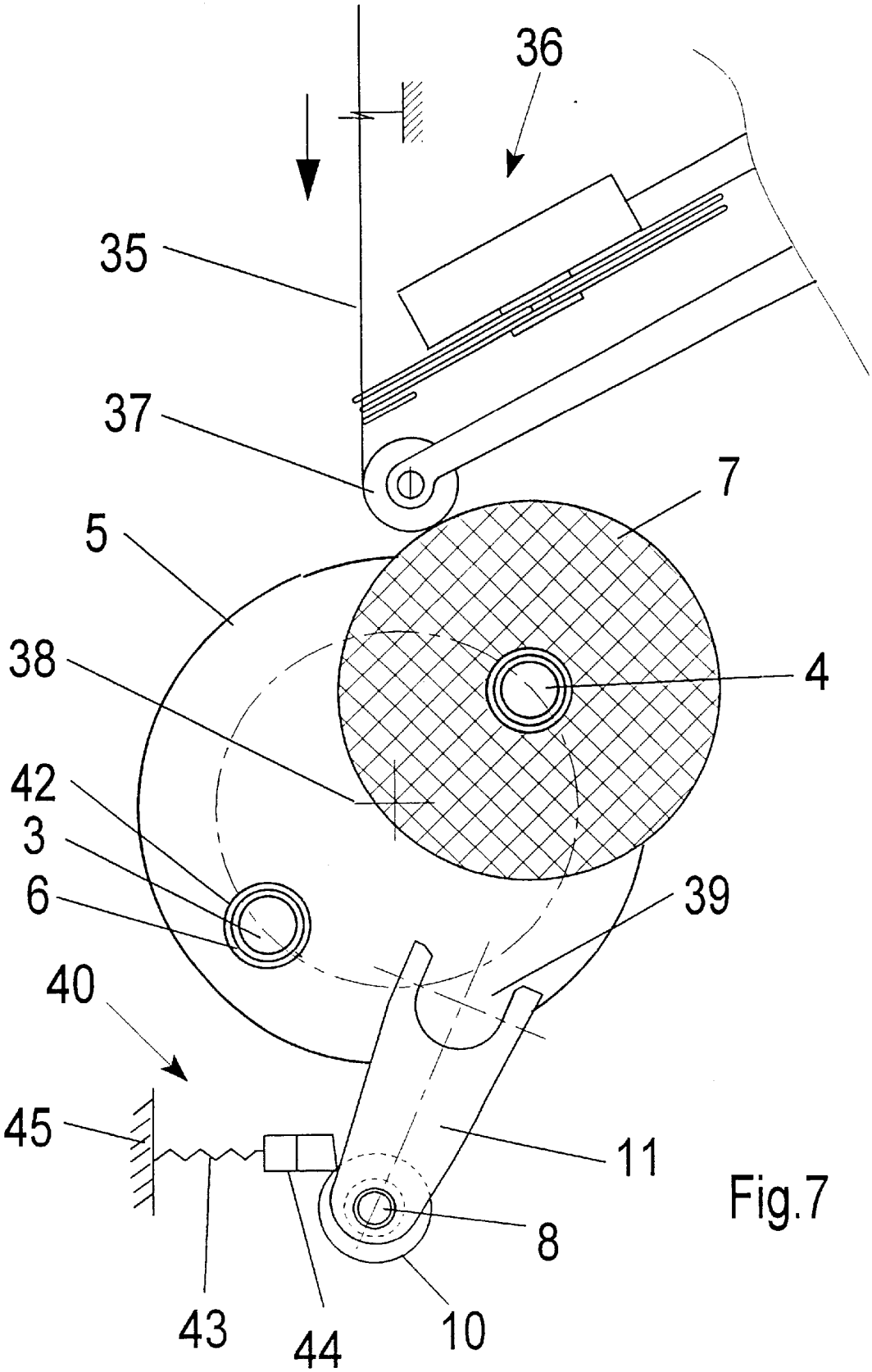
FIGS. 7–9 illustrate different phases before, during, and after a pushing operation.

The push unit 9 comprises a support 10 which is made substantially annular. Same is arranged for sliding movement along the outer surface of cylinder 8. Connected to support 10 is an arm 32, as best seen in FIG. 4. However, it is also possible to connect pusher 11 directly to support 10, as shown in FIG. 7.

For the sliding movement of support 10 on outer surface 34, the support 10 has an opening 31 of a cross section corresponding substantially to the outside cross section of cylinder 8. Formed in support 10 is a receptacle 29, which accommodates a holder 26 with annular magnets 27. In the illustrated embodiment, the number of magnets 27 corresponds to the number of magnets 22 in magnetic piston 21. Between each of magnets 27 a corresponding annular pole plate 28 is arranged. The magnets 27 and pole plates 28 are dimensioned such that the magnets 27 extend opposite to magnets 22 of the magnetic piston. The polarity of magnets 27 is opposite to the polarity of magnets 22 in magnetic piston 21. In this arrangement, the magnets may have an axially aligned magnetization, so that a radially extending opposite polarity is present for applying the magnetic holding forces between the magnetic piston 21 and support 10. However, the magnets may also have a radially aligned magnetization, as is shown in FIG. 2.

The holder 26 is secured by a sleeve 30, which is arranged in receptacle 29.

Figure 3:
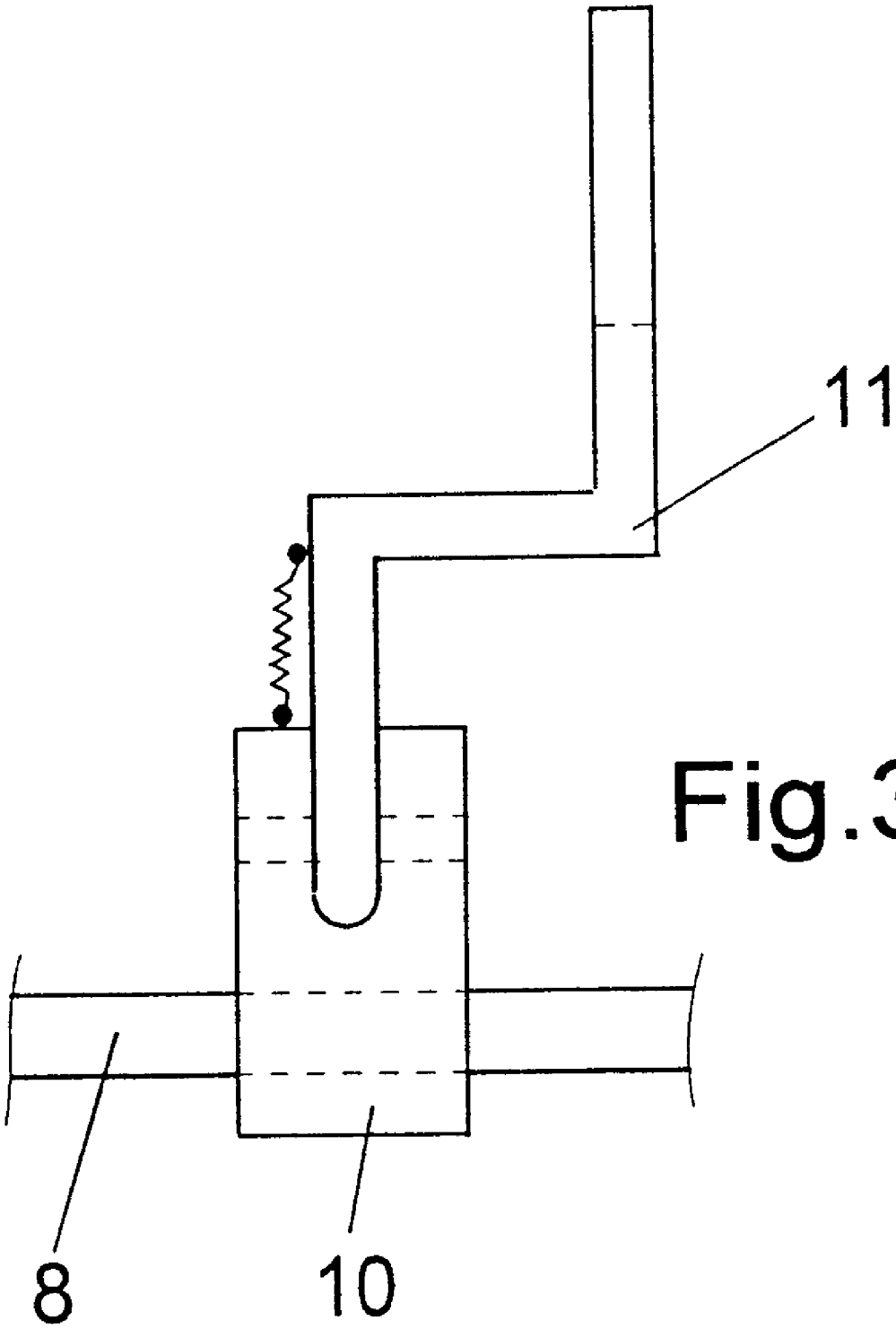
FIG. 3 illustrates a variant of the push unit.

In FIGS. 1 and 2, the pusher 11 is made substantially flat. As an alternative, the pusher 11 may also be offset, as shown in FIG. 3. In this alternative, the offset of pusher 11 is formed in the pushing direction, so that when packages 7 are pushed off and transferred onto a receiving mandrel of a package transportation device, the packages 7 are pushed thereon in a safe and reliable manner.

Figure 5:
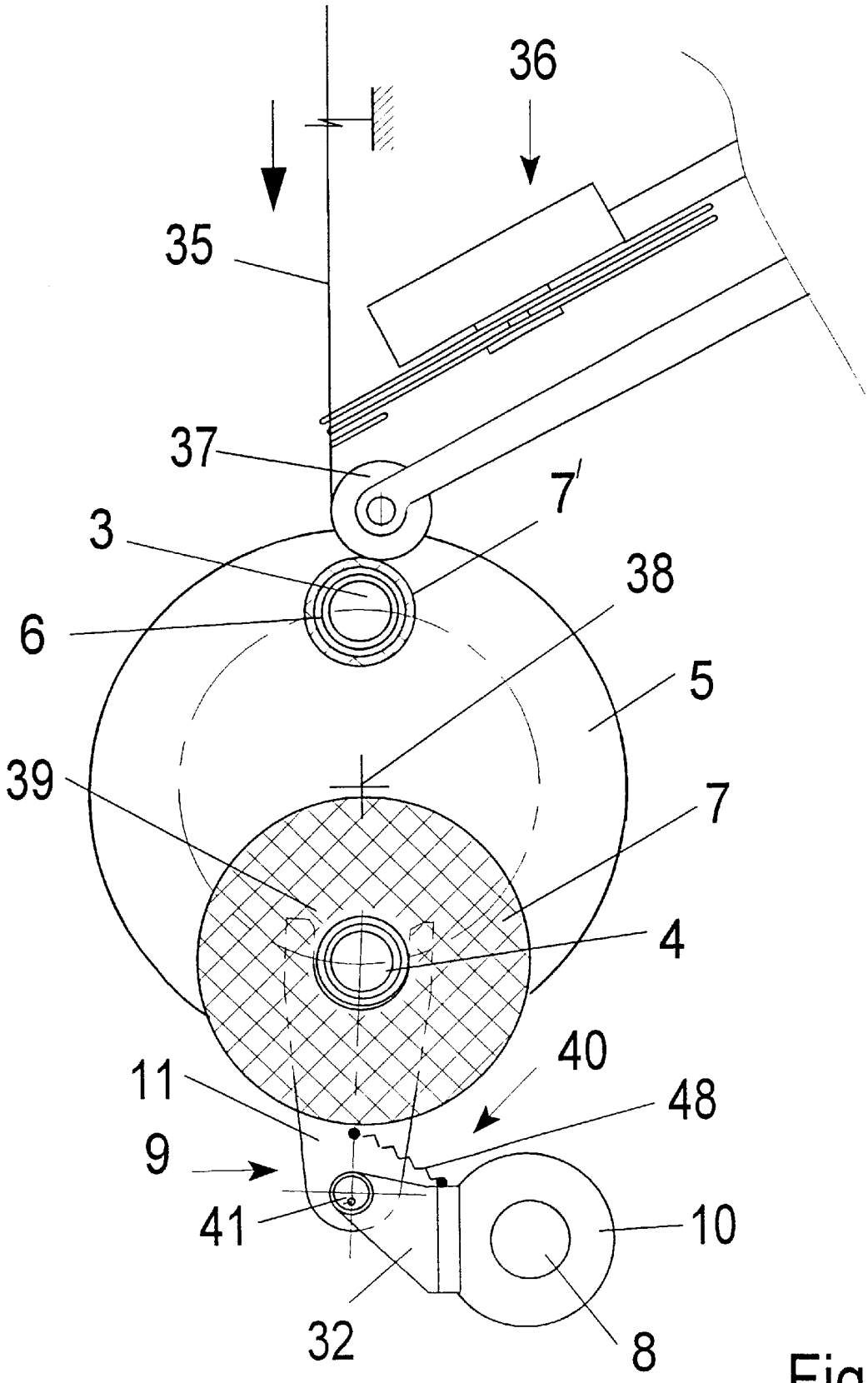
FIG. 5 illustrates a takeup apparatus of FIG. 4 with a push device in a pushing position.

In the following, with reference to FIGS. 4 and 5, the operation and details of the push device are described in combination with a takeup apparatus. The schematically illustrated takeup apparatus comprises a yarn traversing mechanism 36 and downstream thereof, in the direction of an advancing yarn 35, a contact roll 37, which rests against package 7 during a winding operation (winding cycle). The package 7 is wound on a tube 6. The tube 6 is clamped on a winding mandrel 4. The winding mandrel 4 is mounted, together with a diametrically opposite winding mandrel 3, in cantilever fashion, on a rotatable turret plate 5. Upon completion of the winding cycle, the turret plate 5 is rotated in direction of arrow about a turret axis 38. The operation of such a takeup apparatus is described, for example, in EP 0 374 536 B1.

The push unit 9 is in its gripping position. The pusher 11 has at its free end a cutout 39 for engagement with winding mandrel 4. To this end, the cutout 39 extends into the guide path of winding mandrel 4. For a pushing operation, the edge of cutout 39 lies against tube 6 of full package 7, which prevents pusher 11 from interfering with full package 7 during a pushing operation. As also shown in FIG. 4, pusher 11 is positioned against the rotational direction of turret plate 5. The pusher 11 is rotatable about an axis 41 extending substantially parallel to the longitudinal axis of winding mandrels 4 and 3 respectively. The axis 41 is formed on arm 32 which is connected to support 10. The angle of rotation of pusher 11 is limited in direction of the gripping position by a stop not shown on arm 32 and by a resetting unit 40, which is constructed in the form of a tension spring 48.

When the winding cycle of package 7 is completed, the turret plate 5 is rotated until the winding mandrel 3 with a tube 6 has been brought into the winding range. The caught yarn 35 is brought in contact with empty tube 6 rotating along with winding mandrel 3, so that yarn 35 is wound.

During the rotation of turret plate 5, the winding mandrel 4 enters into cutout 39. The pusher 11 is carried along by winding mandrel 4 and rotated about axis 41, until the pusher 11 reaches the position shown in FIG. 5. In this position, the tension spring 48 of resetting unit 40 is tensioned. By supplying the cylinder with a pressure medium, the magnetic piston and the push unit are put into motion, so that the package 7 is pushed off by means of pusher 11 from mandrel 4 and transferred to a receiving mandrel of a package transporting device not shown.

During the pushing operation, the turret plate 5 can continue to rotate, so that a predetermined contact pressure is always present between contact roll 37 and the package 7 being newly wound on mandrel 3. As a result of this rotation, winding mandrel 4 disengages from pusher 11. The pusher 11 is pulled back by tensioned spring 48 of resetting unit 40 to the gripping position shown in FIG. 4. The push unit 9 can be moved on cylinder 8 to the position corresponding to the gripping position, as has been described above.

Figure 6:
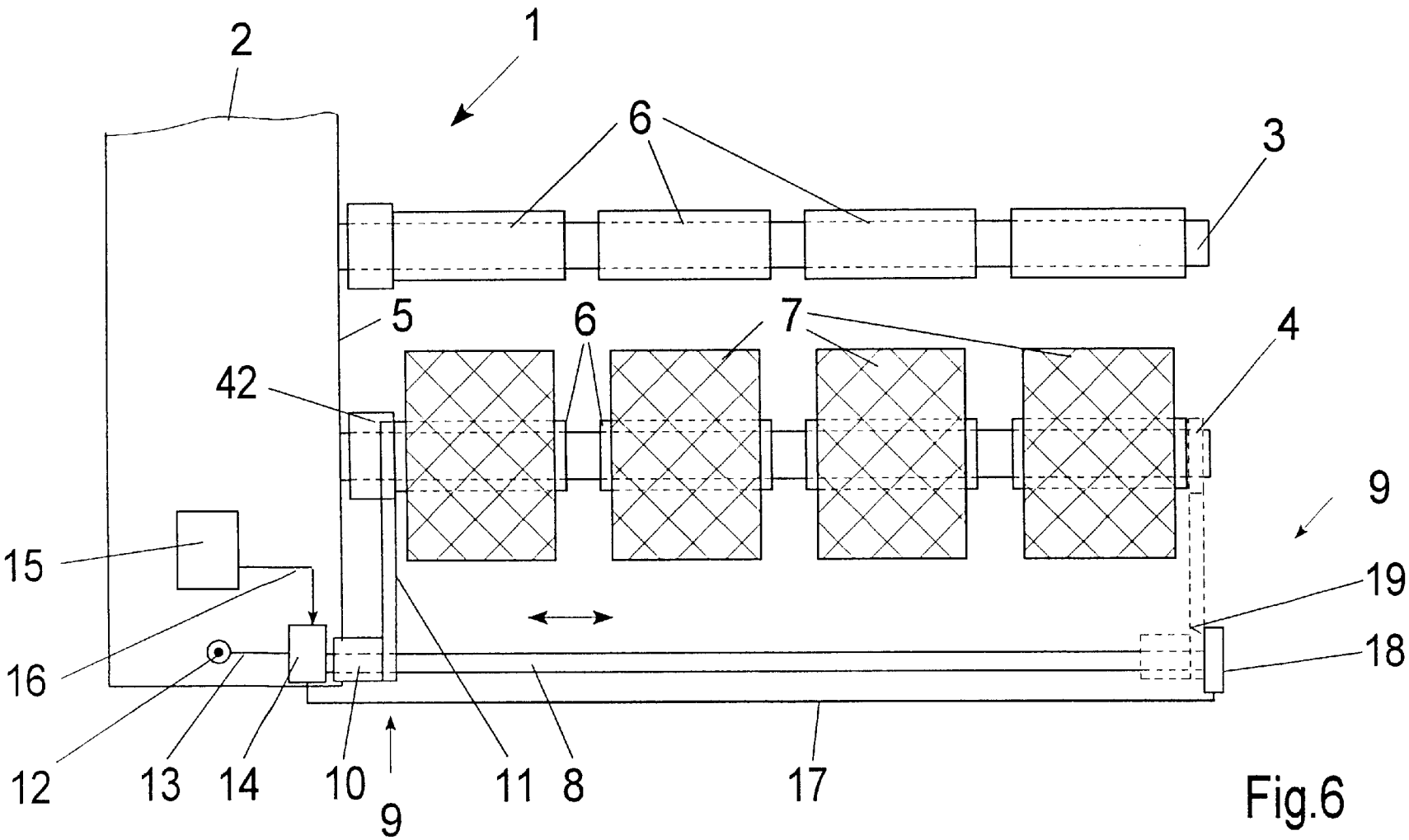
FIG. 6 illustrates a further embodiment of a takeup apparatus and a push device.

FIG. 6 illustrates a takeup apparatus 1, which corresponds in its basic construction to the takeup apparatus shown in FIG. 1. The winding mandrels of the takeup apparatus of FIG. 6 are arranged on a rotatable turret plate. Like parts of the takeup apparatus of FIGS. 1 and 6 are identified by the same numerals. To avoid repetitions, the foregoing description is herewith incorporated by reference.

The takeup apparatus shown in FIG. 6 differs from that of FIG. 1 in that each winding mandrel 3, 4 is provided with a push sleeve 42. In the region of machine frame 2, on the respective winding mandrel 3, 4, each push sleeve 42 is arranged in such a manner that it is nonrotatable and displaceable on the winding mandrel. The push sleeve 42 is designed for engagement with pusher 11 of the pushing device. As shown in FIG. 6, the pusher 11 engages sleeve 42 of winding mandrel 4. The pusher 11 is connected to the support 10 of push unit 9. The layout of push unit 9, which is arranged for displacement along cylinder 8 corresponds to the layout shown in FIG. 2, with pusher 11 being arranged directly on support 10.

Figure 8:
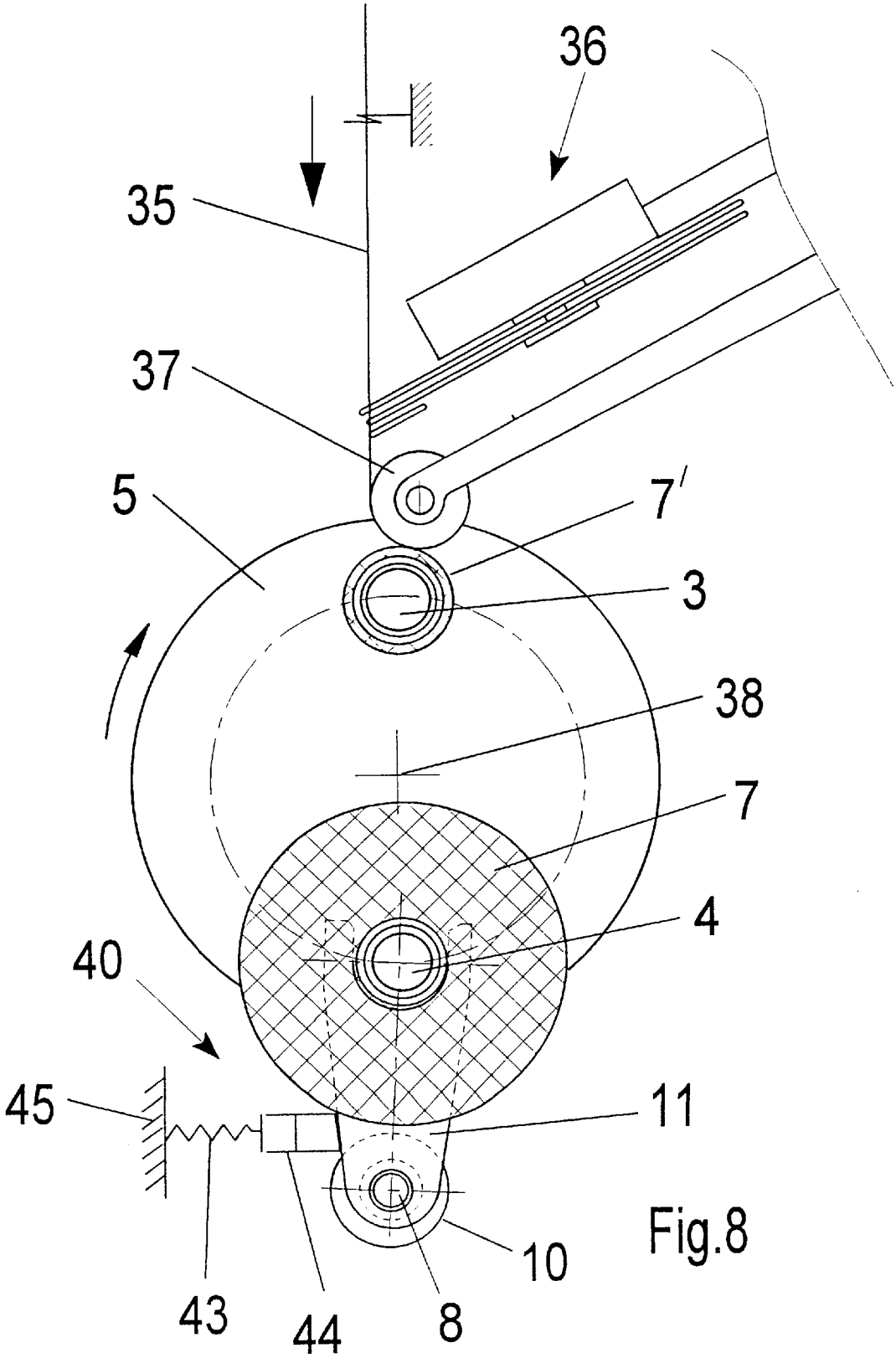
Figure 9:
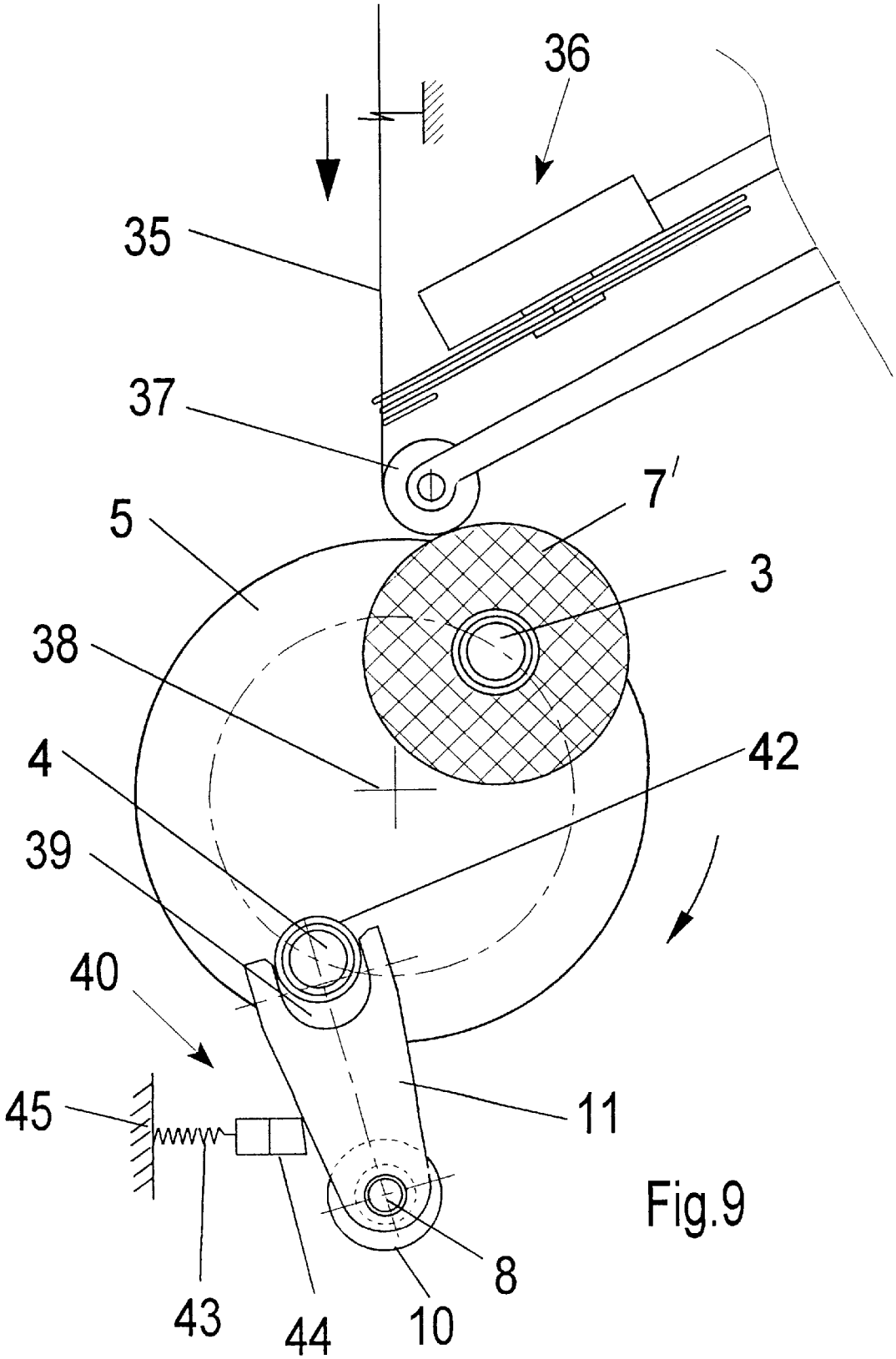

FIGS. 7 to 9 show individual phases of a pushing operation in a takeup apparatus of FIG. 6. As illustrated, the yarn 35 advances into the traversing mechanism 36 of a winding position and, after being deflected on the contact roll, it is deposited on a package being wound. In FIG. 7, the pusher 11 is shown in its gripping position directed against the direction of rotation of turret plate 5. By rotating turret plate 5, the winding mandrel 4 with packages 7 engages in cutout 39 of pusher 11. As turret plate 5 continues to rotate about its axis 38, the pusher 11 is moved to the position shown in FIG. 8. In so doing, the pusher 11 engages push sleeve 42, as shown in FIG. 6. By displacing push unit 9 along cylinder 8, the packages 7 are pushed off winding mandrel 4. During this operation, winding mandrel 3 has reached the winding range of the takeup apparatus. A package 7' has already started to wind on winding mandrel 3. During the entire pushing operation, the pusher 11 is engaged with push sleeve 42. As turret plate 5 continues to rotate, the pusher 11 is deflected from its substantially perpendicular position in the direction of rotation of turret plate 5, as is shown in FIG. 9.

A continued rotation of turret plate 5 about axis 38 causes push sleeve 42 to disengage from cutout 39 of pusher 11.

To move pusher 11 from its deflected position shown in FIG. 9 to its gripping position shown in FIG. 7, resetting unit 40 is provided. The resetting unit 40 comprises a stationarily arranged compression spring 43. One end of compression spring 43 is secured to a holder 45 by fastening means not shown. Arranged at the free end of compression spring 43 is a stop element 44.

Figure 11:
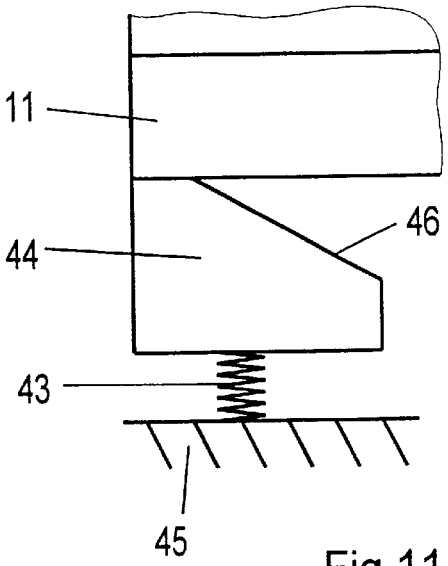
FIGS. 10–11 illustrate a resetting unit with a push unit.
Figure 10:
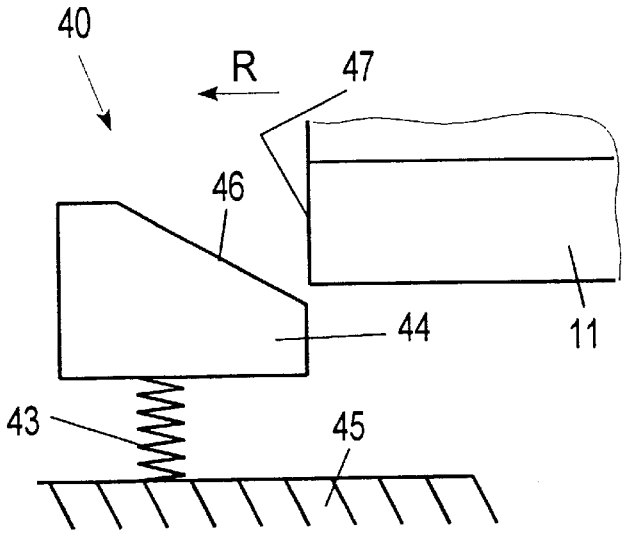

The operation and details of resetting unit 40 shown in FIGS. 7–9 are described in more detail with reference to FIGS. 10 and 11.

The stop element 44 has a surface 46, along which a portion 47 of pusher 11 slides. The surface 46 is inclined at such an angle with respect to the direction of displacement R of pusher 11 along cylinder 8 as to permit removal of pusher 11 from its deflected position shown in FIG. 9 to its gripping position shown in FIG. 7. The surface 46 is brought by compression spring 43 which is connected to holder 45, to the operating range of pusher 11. FIG. 10 shows the position of resetting unit 40, wherein compression spring 43 is relaxed and stop element 44 with surface 46 extends into the operating range of pusher 11. When pusher 11 moves along surface 46, it causes on the one hand compression spring 43 to compress. On the other hand, the pusher 11 is rotated by displaceable stop element 44 to the gripping position of FIG. 7.

What is claimed is:

1. An ejector for pushing yarn packages from a winding spindle onto a receiving mandrel, comprising a tubular casing, a magnetic piston mounted for sliding movement within the tubular casing, a push unit mounted for sliding movement on the outside of the tubular casing and being magnetically coupled to said magnetic piston so that the push unit follows the sliding movement of the magnetic piston, and with said push unit including a pusher which is configured to engage a yarn package mounted on a winding spindle, and control means for selectively moving the magnetic piston and thus the push unit in either direction along the tubular casing.

2. The ejector as defined in claim 1 further including a stop mounted adjacent at least one of the ends of the tubular casing for engaging the push unit and limiting its sliding movement.

3. The ejector as defined in claim 2 wherein the magnetic piston includes at least one disc shaped magnet and wherein the push unit includes at least one annular magnet.

4. The ejector as defined in claim 3 wherein the magnets are permanent magnets.

5. The ejector as defined in claim 1 wherein the magnetic piston and the push unit each include a plurality of successively arranged magnets with a pole plate positioned between adjacent magnets.

6. The ejector as defined in claim 1 wherein the push unit includes a support mounting at least one magnet, and wherein the pusher is pivotally connected to the support for pivotal movement about a pivot axis which is parallel to the direction along which the push unit slides on the tubular casing.

7. The ejector as defined in claim 6 wherein the pusher includes a bifurcated outer end portion which is adapted to partially surround the winding spindle and engage one end of a yarn package mounted thereon.

8. The ejector as defined in claim 7 wherein the pusher is pivotable about said pivot axis between a gripping position and a deflected position, and wherein the push unit further comprises a resetting unit for biasing the pusher toward the gripping position.

9. The ejector as defined in claim 8 wherein the resetting unit comprises a stop element which is displaceable by contact with the pusher as it moves along the tubular casing, and a biasing spring for resisting such displacement, and with the stop element having an inclined surface positioned to be engaged by the pusher as the push unit moves along the tubular casing and so as to move the pusher from its deflected position to its gripping position.

10. The ejector as defined in claim 1 wherein the push unit defines a predetermined path of displacement on the tubular casing, and wherein the ejector has an overall length which substantially corresponds to the predetermined path of displacement.

11. The ejector as defined in claim 10 wherein the control means includes means for selectively delivering a pressurized fluid into either one of the ends of the tubular casing.

12. An apparatus for winding an advancing yarn into a wound yarn package comprising at least one winding spindle defining a spindle axis and a free end, with the one winding spindle being adapted to coaxially support at least one winding tube thereon, an ejector for pushing one or more yarn packages axially off from the free end of the winding spindle and onto a receiving mandrel, said ejector comprising (a) a tubular casing having a central axis and being mounted adjacent and parallel to the one winding spindle, (b) a magnetic piston mounted for sliding movement within the tubular casing, (c) a push unit mounted for sliding movement on the outside of the tubular casing and being magnetically coupled to said magnetic piston so that the push unit follows the sliding movement of the magnetic piston, and with said push unit including a pusher which is configured to engage a yarn package mounted on said one winding spindle, and (d) control means for selectively moving the magnetic piston and thus the push unit in either direction along the tubular casing.

13. The yarn winding apparatus as defined in claim 12 wherein the winding apparatus comprises at least two of said winding spindles mounted on a rotatable turret, and such that each winding spindle and associated winding tubes may be selectively moved between a winding position and a doffing position upon rotation of said turret, and wherein said ejector is mounted so as to be adjacent the winding spindle which is in the doffing position.

14. The yarn winding apparatus as defined in claim 13 wherein the push unit includes a support mounting at least one magnet, and wherein the pusher is pivotally connected to the support for pivotal movement about a pivot axis which is parallel to the central axis of the tubular casing.

15. The yarn winding apparatus as defined in claim 14 wherein the pusher includes a bifurcated end portion which is sized to partially surround the winding spindle which is in the doffing position, and wherein the pusher is pivotable between a gripping position wherein the bifurcated end portion of the pusher is received upon the winding spindle in the doffing position, and a deflected position.

16. The yarn winding apparatus as defined in claim 15 wherein the push unit further comprises a resetting unit for biasing the pusher toward the gripping position.

17. The yarn winding apparatus as defined in claim 16 wherein the push unit is moveable along the tubular casing between an extended position adjacent the free end of the winding spindle at the doffing position, and a withdrawn position adjacent the opposite end of the winding spindle at the doffing position, and wherein the resetting unit is mounted adjacent the withdrawn position of the push unit so as to engage the pusher as the push unit moves from its extended position toward its withdrawn position.

* * * * *